US008012922B2

(12) United States Patent
Tsai et al.

(10) Patent No.: US 8,012,922 B2
(45) Date of Patent: Sep. 6, 2011

(54) WET CLEANING SOLUTION

(75) Inventors: Cheng-Yuan Tsai, Hsinchu (TW); Chih-Lung Lin, Taipei (TW); Cheng-Chen Hsueh, Taipei (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 155 days.

(21) Appl. No.: 11/703,752

(22) Filed: Feb. 8, 2007

(65) Prior Publication Data

US 2008/0194452 A1 Aug. 14, 2008

(51) Int. Cl.
*C11D 1/88* (2006.01)
*C11D 3/28* (2006.01)
*C11D 3/43* (2006.01)

(52) U.S. Cl. ..... 510/176; 510/175; 510/245; 510/264; 510/500; 510/505

(58) Field of Classification Search ..... 510/123, 510/159, 175, 176, 245, 264, 423, 435, 500, 510/505
See application file for complete search history.

(56) References Cited

U.S. PATENT DOCUMENTS

| | | | | |
|---|---|---|---|---|
| 4,207,215 | A * | 6/1980 | Bolan | 510/238 |
| 5,409,640 | A * | 4/1995 | Giret et al. | 510/417 |
| 5,714,453 | A * | 2/1998 | Neumiller | 510/405 |
| 5,883,059 | A * | 3/1999 | Furman et al. | 510/130 |
| 7,241,729 | B2 * | 7/2007 | Sivik et al. | 510/475 |
| 7,314,852 | B1 * | 1/2008 | Cummings et al. | 510/163 |
| 2005/0142091 | A1 * | 6/2005 | Watanabe | 424/70.12 |
| 2005/0148480 | A1 * | 7/2005 | Croce | 510/201 |

* cited by examiner

*Primary Examiner* — Gregory R Del Cotto
(74) *Attorney, Agent, or Firm* — Birch, Stewart, Kolasch & Birch, LLP

(57) ABSTRACT

A wet cleaning solution, comprising 0.01-3 wt % of an amphoteric imidazolium surfactant capable of forming a complex with metal ions, a pH adjuster, and balanced deionized water. The wet cleaning solution is substantially free of corrosion inhibitor other than the imidazolium amphoteric surfactant.

9 Claims, 7 Drawing Sheets

WET CLEANING SOLUTION

BACKGROUND OF THE INVENTION

1. Field of the Invention

The invention relates to a wet cleaning solution, and in particular to a wet cleaning solution suitable for cleaning hydrophobic semiconductor substrates after chemical mechanical polishing (CMP).

2. Description of the Related Art

As the geometry of semiconductor devices continues to decrease, trace amounts of contaminants remaining on a semiconductor substrate have more significant effects on device performance and yield, demanding much stricter contamination control. Therefore, cleaning with a variety of liquid cleaners is conducted in individual steps in processes for manufacturing a semiconductor device.

For example, in the steps for manufacturing a multilayered semiconductor device, CMP is common for leveling an insulating film or forming a damascene interconnection, with adequately effective removal of contaminants required during cleaning following such process. After CMP, the wafer surface is contaminated with a large amount of particles or metallic contaminants. The particles originate with the polishing particles (inorganic particles such as silica or alumina) in the slurry, and the metallic contaminants are derived from interconnection material such as copper, polished during formation of damascene interconnection or a via metal. Thus, before continuing the construction of the integrated circuits, a post-CMP cleaning process is necessary to remove contaminants such as particles and metallic contaminants while preventing damage to a metal interconnection or insulating layer exposed on a substrate surface.

The interconnection delay has become a major concern in modern IC (Integrated Circuit) design. Thus, the interconnection delay is conventionally reduced by using a low-resistivity material such as copper (Cu) as an interconnection material and further using a low dielectric-constant (low-k) material in place of a conventional silicon dioxide as a material for an interlayer insulating film or an inter-interconnection insulating film.

Such a low-k material is, however, less wettable, i.e., more hydrophobic, than the conventional silicon oxide. Therefore, hydrophobic substrates are more difficult to clean than hydrophilic substrates, due to the poor wettability of aqueous cleaning solutions on hydrophobic low-k dielectric substrates. Also, the efficiency of chemical residues removed by deionized water rinsing is very low. Watermarks or residues are commonly observed on the hydrophobic surfaces during drying, which may cause subsequent device failure. The semiconductor industry is increasing the use of low-k dielectric wafers and, hence, much attention has been directed to improved methods for cleaning hydrophobic substrates.

Accordingly, a need exists for an improved cleaning solution and method for cleaning hydrophobic substrates.

BRIEF SUMMARY OF THE INVENTION

According to one aspect of the invention, a wet cleaning solution is provided. An exemplary wet cleaning solution comprises 0.001-0.1 wt % of an amphoteric imidazolium surfactant capable of forming a complex with metal ions; a pH adjuster; and balanced deionized water. The cleaning solution is substantially free of corrosion inhibitor aside from the amphoteric imidazolium surfactant.

According to another aspect of the invention, a method of cleaning a substrate is provided. An exemplary method comprises providing a substrate having a hydrophobic surface; and applying the disclosed wet cleaning solution onto the substrate for cleaning.

A detailed description is given in the following embodiments with reference to the accompanying drawings.

BRIEF DESCRIPTION OF THE DRAWINGS

The invention can be more fully understood by reading the subsequent detailed description and examples with references made to the accompanying drawings, wherein.

DETAILED DESCRIPTION OF THE INVENTION

The following description is of the best-contemplated mode of carrying out the invention. This description is made for the purpose of illustrating the general principles of the invention and should not be taken in a limiting sense. The scope of the invention is best determined by reference to the appended claims.

Figure 1:
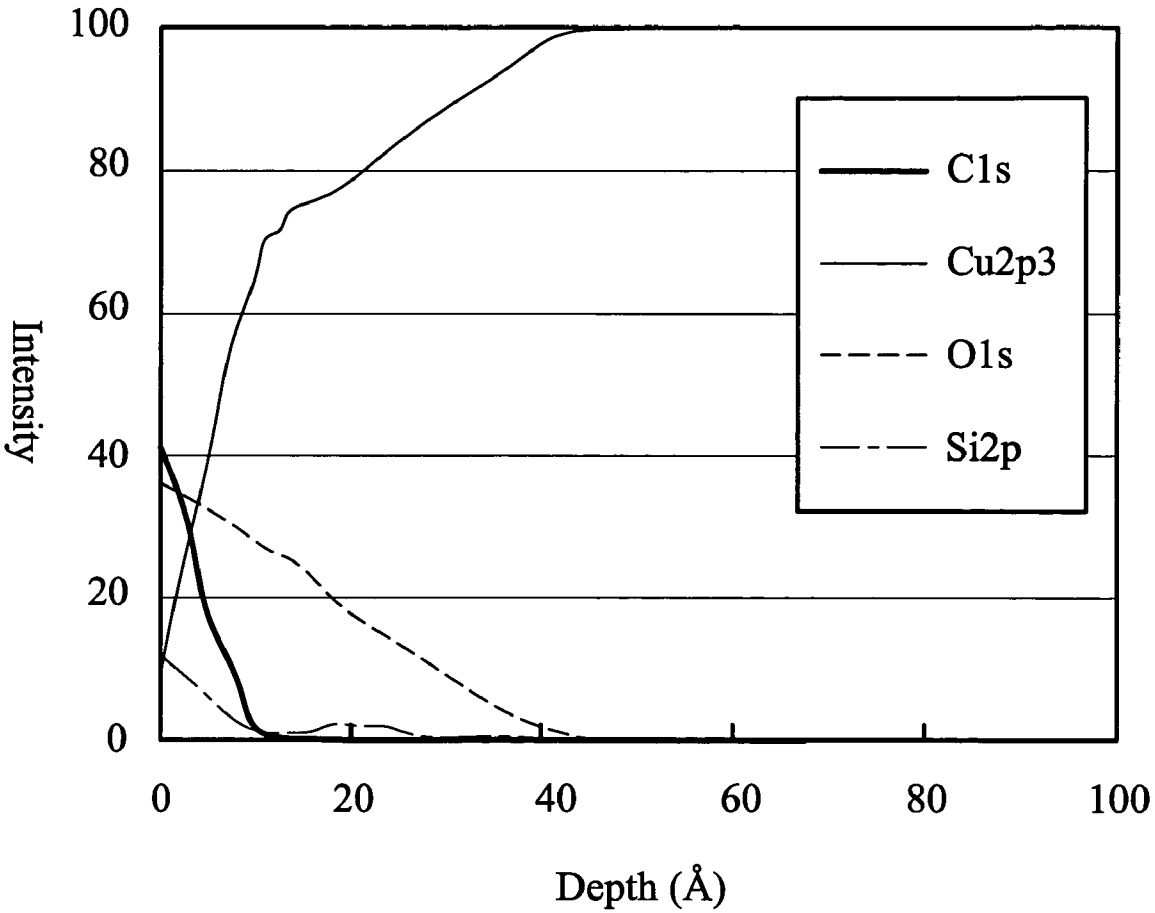
FIG. 1 shows XPS (X-ray Photoelectron Spectroscopy) spectra of a post-CMP substrate with native copper oxide.
Figure 2:
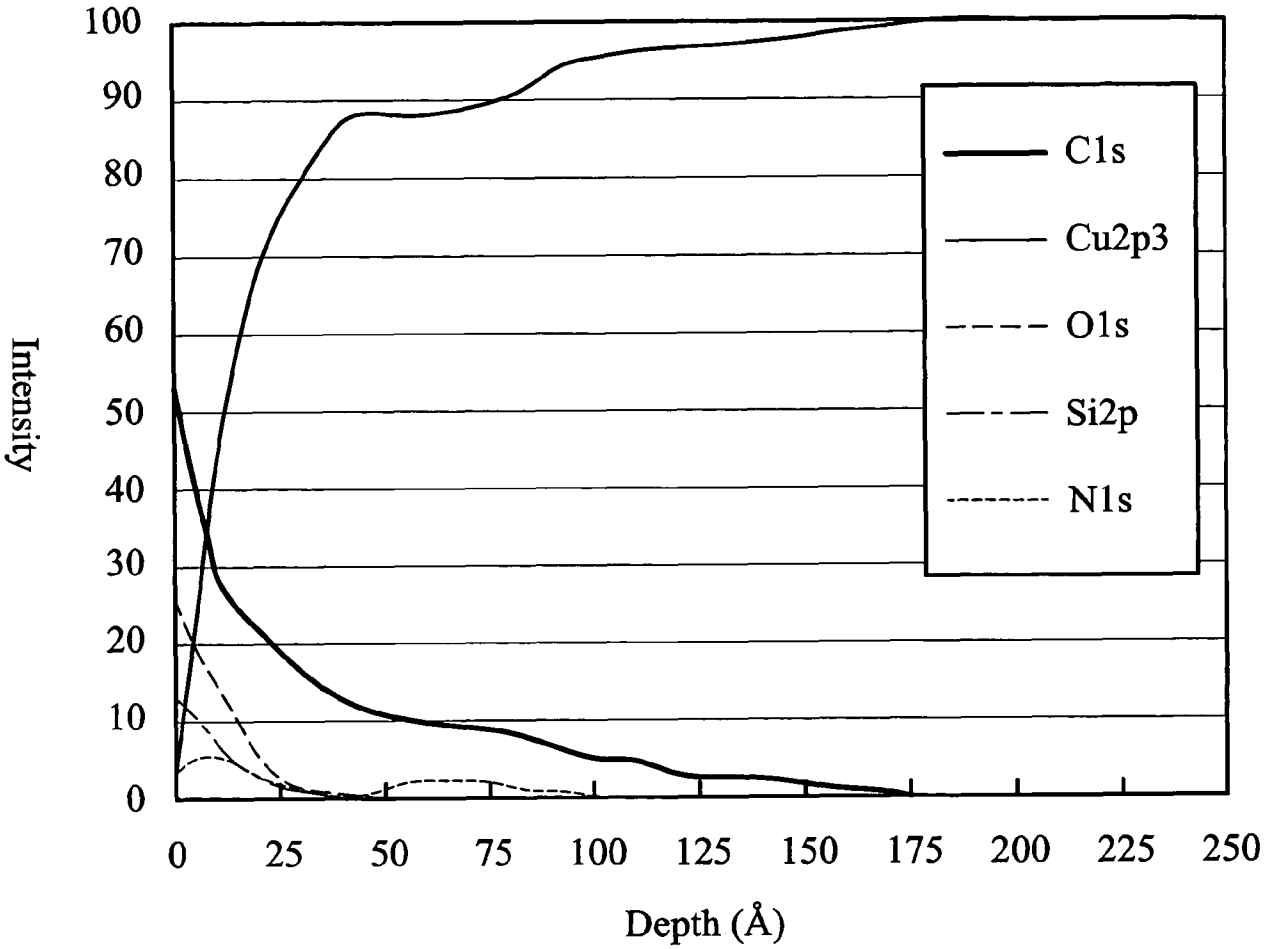
FIG. 2 shows XPS spectra of a post-CMP substrate after treatment of BTA.

Conventional post-CMP cleaning solutions comprise: (a) deionized water; (b) a surfactant to lower the surface tension of the solution, allowing easier spreading; (c) a corrosion inhibitor to minimize copper corrosion; (d) a chelating agent to remove metal contaminates; (e) an organic solvent to dissolve organic residues; and (f) a pH adjuster. As noted, a corrosion inhibitor is commonly used to inhibit corrosion of the copper surface. The corrosion inhibitor forms a complex with copper, resulting in a polymeric barrier between copper and its environment to stop further oxidation. According to the present inventors' investigation, however, the copper-inhibitor complex can penetrate the copper film, causing an increase in interconnect resistance or even device failure. FIG. 1 shows XPS spectra of a post-CMP copper surface as received, and FIG. 2 shows XPS spectra of a post-CMP copper surface after treatment of benzotriazole (BTA), a typical corrosion inhibitor. The XPS analysis indicates that although the treatment of corrosion inhibitor can substantially eliminate the formation of copper oxide, a significant amount of copper-BTA polymer remains within the copper film.

Accordingly, the invention generally aims to eliminate the need for corrosion inhibitor in post-CMP cleaning to prevent polymer residue on copper metallization. To achieve this goal, the invention employs an amphoteric imidazolium surfactant capable of acting as a corrosion inhibitor. Thus, a wet cleaning solution having superior performance in post-CMP cleaning is provided in the absence of conventional corrosion inhibitors such as benzotriazole (BTA).

The cleaning solution of the invention generally comprises an amphoteric imidazolium surfactant capable of forming a complex with metal ions; a pH adjuster; balance deionized water, and may optionally comprise a non-ionic surfactant and an alkyl alcohol. Constituents of the cleaning solution of the invention are described in greater detail as follows.

The surfactant used in the invention is an amphoteric imidazolium surfactant which can form a complex with metal ions, particularly copper ions. In addition to the wetting function, the surfactant of the invention plays the role of corrosion inhibitor, that is, forming a copper complex to protect the copper surface from corrosion. The amphoteric imidazolium surfactant suitable for use in the invention can be represented by the general formula:

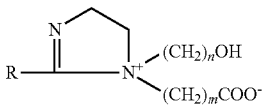

Figure 3:
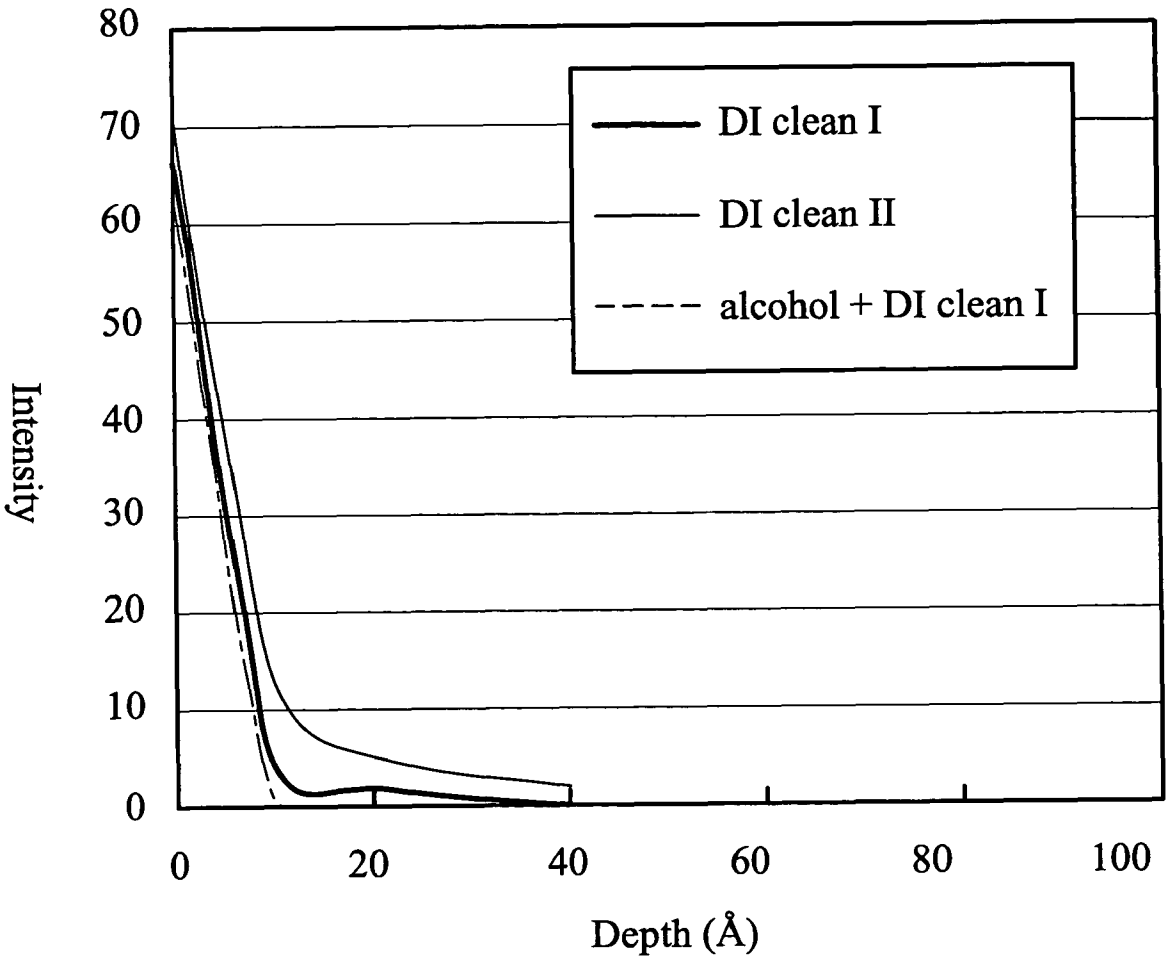
FIG. 3 shows XPS spectra of carbon for copper surface after cleaning with an amphoteric imidazolium surfactant.
Figure 4:
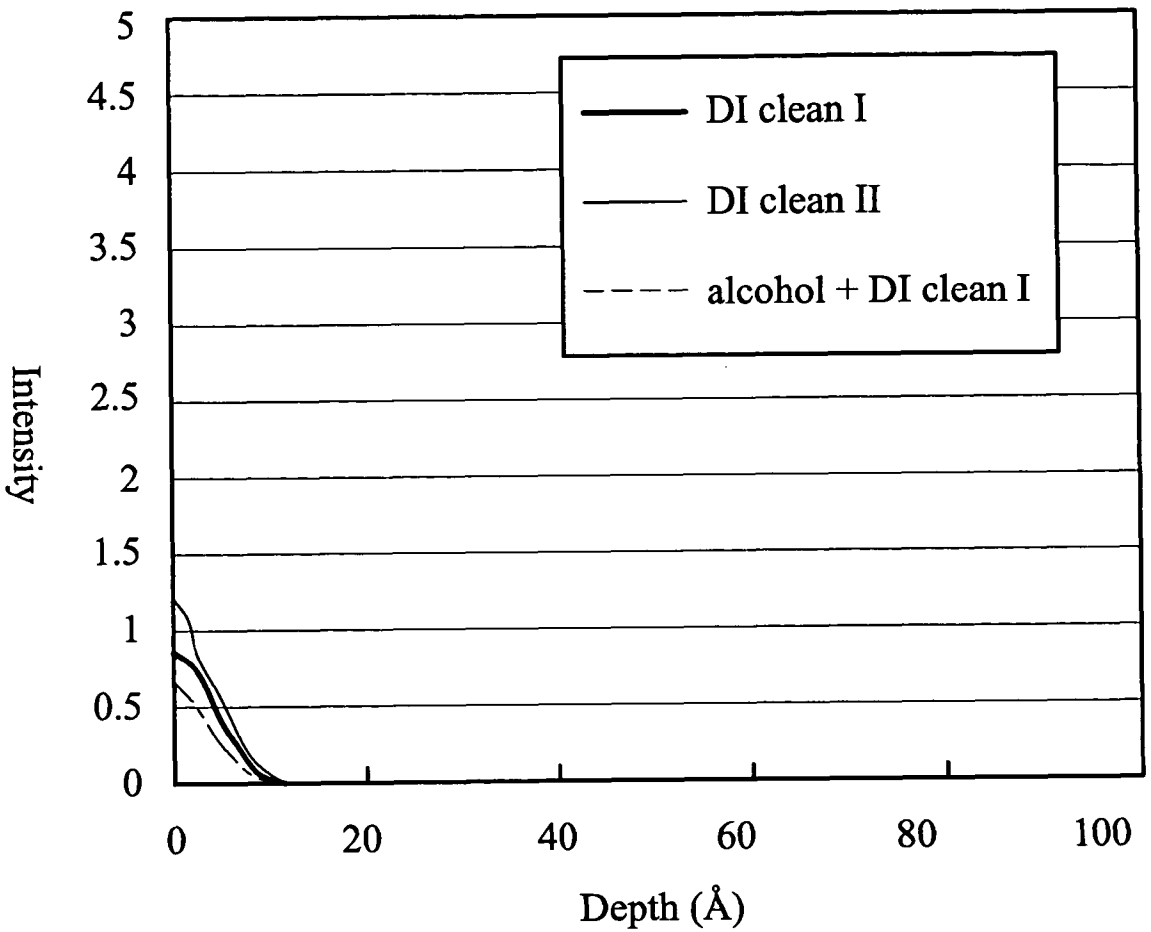
FIG. 4 shows XPS spectra of nitrogen for copper surface after cleaning with an amphoteric imidazolium surfactant.

In the formula, R represents alkyl or alkenyl group thereof, n is an integer of 1 to 4, and m is an integer of 1 to 4. It is believed that the bonding between copper ions and the imidazolium molecule is relatively weaker than that between copper ions and conventional corrosion inhibitors such as BTA. Therefore, a relatively "mild" complex that is easy to remove avoids polymer residue on copper metallization. This has been confirmed by XPS analysis. FIGS. 3 and 4 are XPS spectra of carbon and nitrogen, respectively, for copper surfaces after cleaning with a solution containing amphoteric imidazolium surfactant as a corrosion inhibitor, wherein DI clean I was carried out by soaking, and DI clean II was carried out by washing. As shown, the profiles of carbon and nitrogen rapidly tail off in treated copper films at a depth of about 10 Å, indicating no substantial organic residue.

In the most concise form, the cleaning solution of the invention simply consists of deionized water, a surfactant, and a pH adjuster. In other words, the cleaning solution of the invention can be free of conventional corrosion inhibitors and chelating agents. Typical examples of conventional corrosion inhibitors include BTA, gallic acid, catechol, ascorbic acid, and resorcinol. Typical examples of conventional chelating agents include (ethylenedinitrilo)tetraacetic acid (EDTA), butylenediaminetetraacetic acid, (1,2-cyclohexylenedinitrilo)tetraacetic acid (CyDTA), ethylene diamine (EDA), glycine, acetic acid, and oxalic acid. The cleaning solution therefore provides an economic advantage since an effective cleaning solution can be formulated more cheaply, which is of importance since such a post-CMP cleaning solution is used in large quantities.

Commercially available amphoteric imidazolium surfactants include, for illustration, MIRANOL series manufactured by Miranol Chemical Company, or LF series manufactured by Hoclean Chemical Company. A particularly preferred surfactant is 2-alkyl-1-carobxymethyl-1-hydroxyethyl imidazolium betaine. The surfactant is preferably present in the solution in an amount of about 0.001-0.1 wt %, more preferably about 0.01-0.08 wt %.

The cleaning solution further comprises a pH adjuster for adjusting the pH of the solution and balanced deionized water. The pH adjuster may comprise an organic base, an inorganic base, or combinations thereof. Examples of inorganic bases include, but are not limited to, sodium hydroxide, sodium carbonate, sodium bicarbonate, calcium hydroxide, and calcium carbonate. Examples of organic bases include, but are not limited to, quaternary ammonium hydroxides such as tetramethyl ammonium hydroxide (TMAH), hydroxylamines such as N-methylhydroxylamine, heterocyclic amines such as pyridine, and alkanoamines series, such as 2-aminoethanol, 1-amino-2-propanol, etc. and aqueous ammonia.

Figure 5:
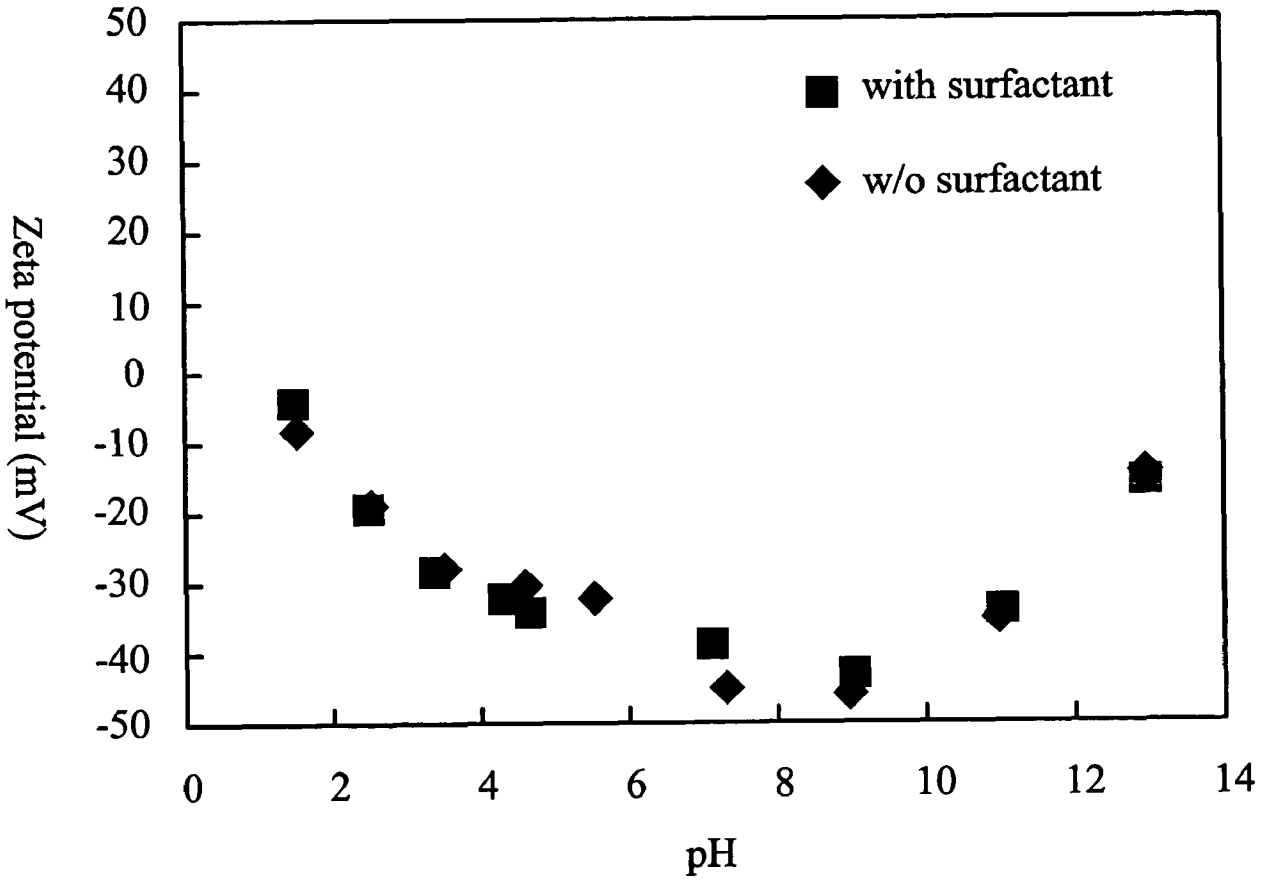
FIG. 5 is a diagram of the zeta potential of silica colloidal as a function of pH, in which the presence and absence of a surfactant is compared.
Figure 6:
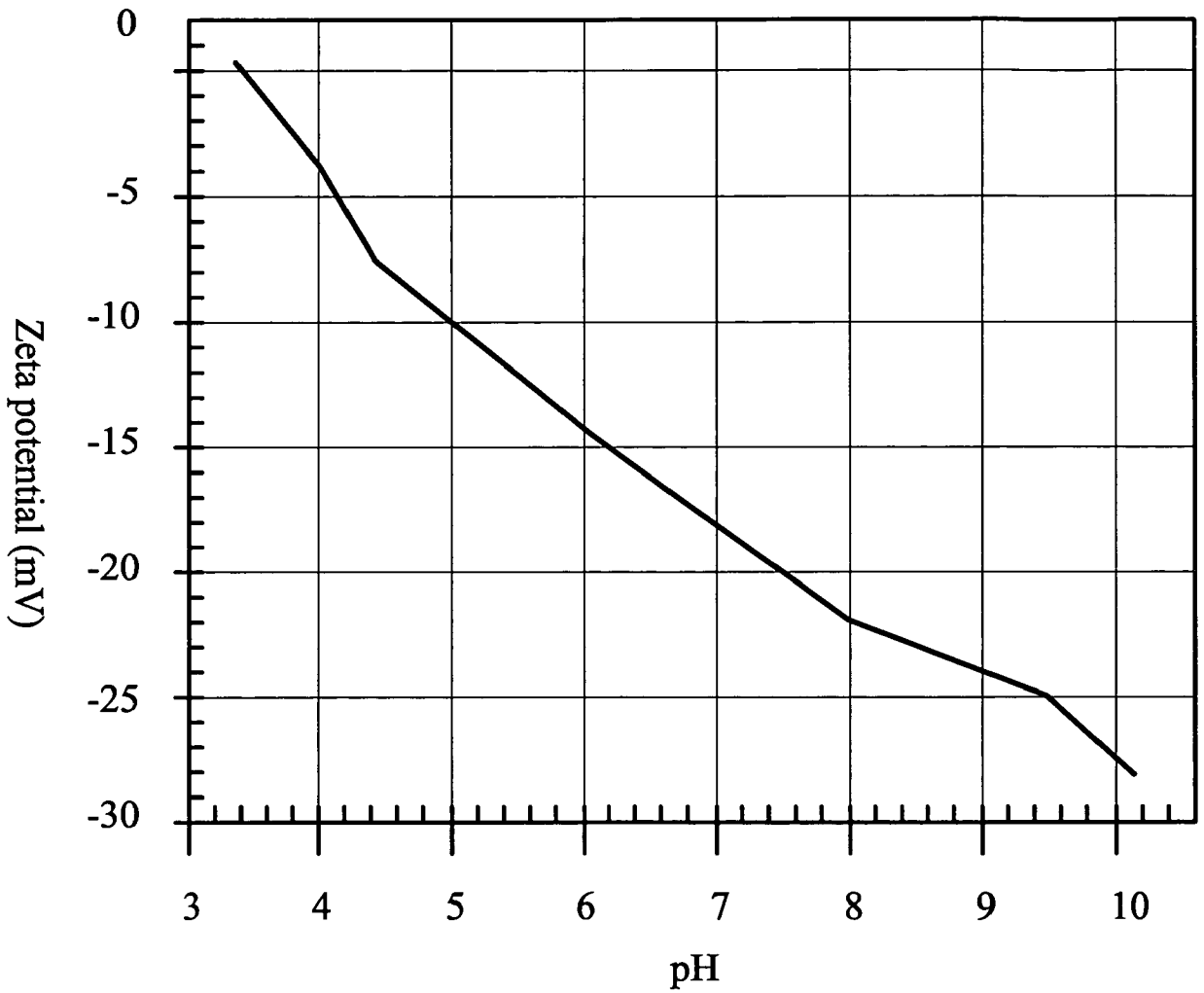
FIG. 6 is a diagram of the zeta potential of organosilicate (OSG) as a function of pH.
Figure 7:
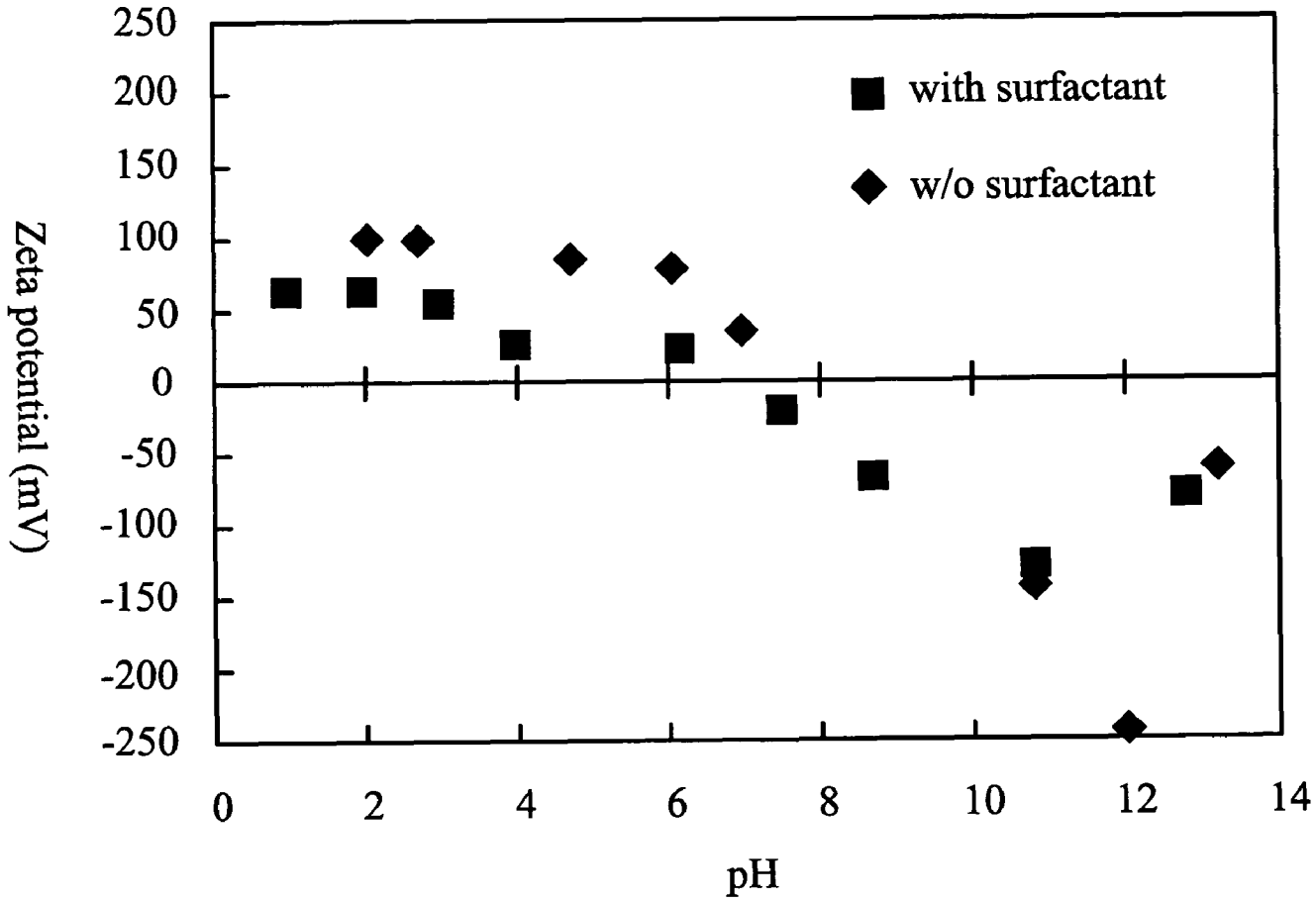
FIG. 7 is a diagram of the zeta potential of copper oxide as a function of pH, in which the presence and absence of a surfactant is compared.

The amount of base added to the solution should be sufficient to obtain a desired operating pH. FIGS. 5-7 are diagrams of the zeta potential of silica colloidal, organosilicate (OSG), and copper oxide, respectively, as a function of pH. FIG. 5 indicates that the repelling force of silica colloidal is maximized at about pH 9. FIG. 6 indicates that the repelling force of organosilicate increases with pH value. FIG. 7 indicates that the repelling force of copper oxide is maximized at about pH 10. Accordingly, the optimum operating pH is between 8 and 10, preferably between 9 and 9.5. The optimum pH level maximizes the zeta potential magnitude or repelling force to prevent the slurry particles from binding together due to Van der Wals forces and thus aids the removal of slurry particles.

The cleaning solution may optionally comprise a non-ionic surfactant to increase the wetting of the hydrophobic surface to be cleaned, thereby improving the cleaning action. Examples of suitable non-ionic surfactants include, but are not limited to, poly(alkylene oxide)surfactants, alkynol surfactants, siloxane type surfactant, and fluorinated surfactants such as fluorinated alkyl alkoxylates, and fluorinated polyoxyethylene alkanols. Preferred non-surfactants to be used in combination with the amphoteric imidazolium surfactant include non-ionic polyethoxy surfactants such as Hoclean TX-series from Hoclean Chemical Corporation. The non-ionic surfactant is preferably present in the solution in an amount of 0.01-0.1 wt %, more preferably 0.03-0.08 wt %.

Table 1 shows that the surface tension and contact angles of the cleaning solution were reduced after the addition of non-ionic surfactant.

TABLE 1

| | Ultra-pure water | 5 wt % LF | 0.09 wt % TX + 0.05 wt % LF |
|---|---|---|---|
| Surface tension (dyne/cm) | 71.5 | 31.6 | 26.5 |
| Contact angle at OSG | 56 | 16 | <10 |
| Contact angle at pure Cu | 52 | About 5 | About 5 |
| Contact angle at CuO | 81 | 18 | About 10 |

Alkyl alcohol may also be optionally added to the cleaning solution to aid dissolution of organic residue and facilitate the dry speed. Examples of alkyl alcohol suitable for use herein include, but are not limited to, methanol, ethanol, isopropyl alcohol, butanol, ethylene glycol, and propylene glycol. The alkyl alcohol is preferably present in the solution in an amount of 1-15 wt %, more preferably 3-10 wt %.

Thus, the wet cleaning solution of the invention preferably consists essentially of 0.001-0.1 wt % of an imidazolium amphoteric surfactant capable of forming a complex with metal ions; 0.01-0.1 wt % of a non-ionic polyethoxy surfactant; 1-15 wt % of an alkyl alcohol; a pH adjuster; and balance deionized water, wherein the pH value of the wet cleaning solution is between 8 and 10.

The cleaning solution of the invention is particularly useful on a semiconductor substrate having a hydrophobic surface. A "semiconductor substrate" used herein refers to a substrate manufactured for use in microelectronic, integrated circuit, or computer chip applications. The hydrophobic surface may include, for example, copper metallization and low-k films. The term "low-k film" denotes a film having a low dielectric-constant of less than 4. Hydrophobic low-k films known in the art include organosilicate glass (OSG, also known as carbon-doped oxide), hydrogen silsesquioxane (HSQ), methyl silsesquioxane (MSQ), poly(arylene ether) (PAE), nanoporous silica (Nanoglass), or amorphous fluorinated carbon (a-CF). It is understood that the substrate surface may also include materials such as TiN, Ta, TaN, TiW as copper diffusion barrier. Typically, cleaning of these exemplary materials is performed after chemical mechanical polishing.

The method of cleaning a substrate using the cleaning solution of the invention involves contacting a hydrophobic substrate having residue thereon, particularly particles and metallic contaminants, with a cleaning solution of the invention for a time and at a temperature sufficient to remove the contaminants. Stirring, agitation, circulation, sonication or other techniques as are known in the art optionally may be used. The substrate is generally immersed in the cleaning solution. The time and temperature are determined based on the particular material being removed from a substrate. Generally, the temperature is in the range of from about ambient or room temperature to 70° C. and the contact time is from about 1 to 60 minutes. The preferred temperature and time of contact for this invention is 25 to 60° C. from 2 to 60 minutes.

Although the cleaning solution of the invention is particularly useful in post-CMP cleaning, it may find application for any cleaning operation during the fabrication of semiconductor substrates such as post-via-etch cleaning. Furthermore, although a low-k film has been described as hydrophobic materials by way of example, the cleaning techniques of the invention can be used to clean other types of hydrophobic materials.

The invention is described in greater detail with reference to the following non-limiting examples.

While the invention has been described by way of example and in terms of preferred embodiment, it is to be understood that the invention is not limited thereto. To the contrary, it is intended to cover various modifications and similar arrangements (as would be apparent to those skilled in the art). For example, the cleaning solution described herein can be used to clean any type of hydrophobic surface, whether it be in the semiconductor arts (e.g., semiconductor wafers, flat panel display wafers, etc.), or other fields desiring very clean hydrophobic surfaces. Therefore, the scope of the appended claims should be accorded the broadest interpretation so as to encompass all such modifications and similar arrangements.

What is claimed is:

1. A hydrophobic semiconductor substrate cleaning solution, consisting of:

an imidazolium amphoteric surfactant capable of forming a complex with metal ions;

a pH adjuster; and balance deionized water.

2. A method of cleaning a substrate, comprising:

providing a substrate comprising:

providing a subtrate having a hydrophobic surface; and applying a hydrophobic semiconductor substrate cleaning solution as set forth in claim 1 onto the substrate for cleaning.

3. The method as claimed in claim 2, wherein the hydrophobic surface of the substrate comprises copper metallization and a low-k film.

4. The method as claimed in claim 3, wherein the low-k film comprises organosilicate glass (OSG), hydrogen silsesquioxane (HSQ), methyl silsesquioxane (MSQ), poly (arylene ether) (PAE), nanoporous silica, or amorphous fluorinated carbon (a-CF).

5. The method as claimed in claim 2, further comprising chemical-mechanical polishing the substrate prior to applying the hydrophobic semiconductor substrate cleaning solution.

6. The method as claimed in claim 2, wherein the pH value of the hydrophobic semiconductor substrate cleaning solution is between 8 and 10.

7. The method as claimed in claim 2, wherein the pH adjuster is an organic base, an inorganic base, or combinations thereof.

8. The method as claimed in claim 2, wherein the amphoteric imidazolium surfactant has the general formula:

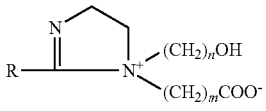

wherein R represents alkyl or alkenyl group, n is an integer of 1 to 4, and m is an integer of 1 to 4.

9. The method as claimed in claim 2, wherein the imidazolium amphoteric surfactant is 2-aklyl-1-carobxymethyl-1-hydroxyethyl imidazolium betaine.

* * * * *